US007446477B2

(12) United States Patent
Reich et al.

(10) Patent No.: US 7,446,477 B2
(45) Date of Patent: Nov. 4, 2008

(54) DIELECTRIC BARRIER DISCHARGE LAMP WITH ELECTRODES IN HEXAGONAL ARRANGEMENT

(75) Inventors: Lajos Reich, Budapest (HU); Attila Agod, Budapest (HU); Szabolcs Beleznai, Gyula (HU); László Jakab, Budapest (HU); Péter Richter, Budakeszi (HU)

(73) Assignee: General Electric Company, Schenectady, NY (US)

( * ) Notice: Subject to any disclaimer, the term of this patent is extended or adjusted under 35 U.S.C. 154(b) by 536 days.

(21) Appl. No.: 11/112,320

(22) Filed: Apr. 22, 2005

(65) Prior Publication Data

US 2006/0006806 A1 Jan. 12, 2006

Related U.S. Application Data

(63) Continuation-in-part of application No. 10/855,347, filed on Jul. 6, 2004.

(51) Int. Cl.
*H01J 29/87* (2006.01)

(52) U.S. Cl. ..... 313/631; 313/607; 313/234

(58) Field of Classification Search ..... 313/607, 313/234, 36, 631
See application file for complete search history.

(56) References Cited

U.S. PATENT DOCUMENTS

| | | | | |
|---|---|---|---|---|
| 5,604,410 | A | 2/1997 | Vollkommer et al. | |
| 5,714,835 | A | 2/1998 | Zachau et al. | |
| 5,769,530 | A * | 6/1998 | Biro et al. | 362/216 |
| 5,994,849 | A | 11/1999 | Vollkommer et al. | |
| 6,060,828 | A | 5/2000 | Vollkommer et al. | |
| 6,777,878 | B2 | 8/2004 | Berlinghof et al. | |
| 6,879,108 | B1 * | 4/2005 | Ilmer et al. | 313/600 |

* cited by examiner

*Primary Examiner*—Joseph L Williams
(74) *Attorney, Agent, or Firm*—Fay Sharpe LLP

(57) ABSTRACT

A dielectric barrier discharge lamp comprises a discharge vessel that has a principal axis, the discharge vessel encloses a discharge volume filled with a discharge gas. The discharge vessel further comprises end portions intersected by the principal axis. There are at least one electrode of a first type and at least one electrode of a second type in the lamp. The electrodes of one type are energized to act as a cathode and the electrodes of other type are energized to act as an anode. The electrodes are substantially straight, elongated and have a longitudinal axis substantially parallel to the principal axis of the discharge vessel. These electrodes are positioned within the discharge volume. The electrodes of at least one type are isolated from the discharge volume by a dielectric layer. A dielectric barrier discharge lamp is also disclosed, in which the electrodes are arranged within the discharge volume in groups, and each of the groups comprises one electrode of the first type and at least one electrode of the second type.

19 Claims, 6 Drawing Sheets

DIELECTRIC BARRIER DISCHARGE LAMP WITH ELECTRODES IN HEXAGONAL ARRANGEMENT

BACKGROUND OF THE INVENTION

This application is a continuation-in-part application of U.S. Ser. No. 10/855,347, filed on 6 Jul. 2004, which is hereby incorporated by reference in its entirety.

This invention relates to a dielectric barrier discharge lamp.

A majority of presently known and commercially available low pressure discharge lamps are the so-called compact fluorescent lamps. These lamps have a gas fill, which also contains small amounts of mercury. Since mercury is a highly poisonous substance, novel types of lamps have been developed recently. One promising candidate to replace mercury-filled fluorescent lamps is the so-called dielectric barrier discharge lamp (shortly DBD lamp). Besides eliminating the mercury, it also offers the advantages of long lifetime and negligible warm-up time.

As explained in detail in U.S. Pat. No. 6,060,828 for example, the operating principle of DBD lamps is based on gas discharge in a noble gas (typically Xenon). The discharge is maintained through a pair of electrodes, between which there is at least one dielectric layer. A voltage of a few kV with a frequency in the kHz range is applied to the electrode pair. Often, multiple electrodes with a first polarity are associated to a single electrode having the opposite polarity. During the discharge, excimers (excited molecules) are generated in the gas, and electromagnetic radiation is emitted when the metastable excimers dissolve. The electromagnetic radiation of the excimers is converted into visible light by suitable luminescent material in a physical process similar to that occurring in mercury-filled fluorescent lamps. This type of discharge is also referred to as dielectrically impeded discharge.

As mentioned above, DBD lamps must have at least one electrode set which is separated from the discharge gas by a dielectric. It is known to employ the wall of the discharge vessel itself as the dielectric. In this manner, a thin film dielectric layer may be avoided. This is advantageous because a thin film dielectric layer is complicated to manufacture and it is prone to deterioration. Various discharge vessel-electrode configurations have been proposed to satisfy this requirement. U.S. Pat. No. 5,994,849 discloses a planar configuration, where the wall of the discharge vessel acts as a dielectric. The electrodes with opposite polarities are positioned alternating to each other. The arrangement has the advantage that electrodes do not cover the discharge volume from at least one side, but a large proportion of the energy used to establish the electric field between the electrodes is dissipated outside the discharge vessel. On the other hand, a planar lamp configuration cannot be used in the majority of existing lamp sockets and lamp housings, which were designed for traditional incandescent bulbs.

U.S. Pat. No. 6,060,828 and No. 5,714,835 disclose substantially cylindrical DBD light sources, which are suitable for traditional screw-in sockets. These lamps have a single internal electrode within a discharge volume, which is surrounded on the external surface of a discharge vessel by several external electrodes. It has been found that such an electrode configuration does not provide a sufficiently homogenous light, because the discharge within the relatively large discharge volume tend to be uneven. Certain volume portions are practically completely devoid of an effective discharge, particularly those volume portions, which are further away from both electrodes.

U.S. Pat. No. 6,777,878 discloses DBD lamp configurations with elongated electrodes that are arranged on the inside of the wall of a cylindrical discharge vessel and are covered by a dielectric layer. In this configuration, the electrodes are in a relatively large distance from each other therefore a very high voltage is required to start ignition. In order to overcome cold starting difficulties, an external metal ring is suggested at one end of the elongated cylindrical discharge vessel. This lamp configuration belongs to the group of DBD lamps of traditional elongated cylindrical shape and cannot be used as a replacement of an incandescent lamp.

Accordingly, there is a need for a DBD lamp configuration with an improved discharge vessel-electrode configuration, for which the ignition is easy to start and keep active, without the need for high operating voltages. There is also need for an improved discharge vessel-electrode configuration which ensures that the electric field and the discharge within the available discharge volume is homogenous and strong, and thereby substantially the full volume of a lamp may be used efficiently. It is sought to provide a DBD lamp, which, in addition to having an improved discharge vessel-electrode arrangement, is relatively simple to manufacture. Further, it is sought to provide a discharge vessel-electrode configuration, which readily supports different types of electrode set configurations, according to the characteristics of the used discharge gas, exciting voltage, frequency and exciting signal shape. The proposed electrode arrangement minimizes the self-shadowing effect of the electrodes in order to provide for a higher luminance and efficiency.

SUMMARY OF THE INVENTION

In an exemplary embodiment of the present invention, a dielectric barrier discharge lamp comprises a discharge vessel that has a principal axis; the discharge vessel encloses a discharge volume filled with a discharge gas. The discharge vessel further comprises end portions intersected by the principal axis. There are at least one electrode of a first type and at least one electrode of a second type in the lamp. The electrodes of one type are energized to act as a cathode and the electrodes of other type are energized to act as an anode. The electrodes are substantially straight, elongated and have a longitudinal axis substantially parallel to the principal axis of the discharge vessel. These electrodes are positioned within the discharge volume. The electrodes of at least one type are isolated from the discharge volume by a dielectric layer.

In an exemplary embodiment of another aspect of the invention, a dielectric barrier discharge lamp comprises a discharge vessel that has a principal axis, the discharge vessel encloses a discharge volume filled with a discharge gas. The discharge vessel further comprises end portions intersected by the principal axis. There are electrodes of a first type and electrodes of a second type in the lamp. The electrodes of one type are energized to act as a cathode and the electrodes of other type are energized to act as an anode. The electrodes are substantially straight, elongated and have a longitudinal axis substantially parallel to the principal axis of the discharge vessel. These electrodes are arranged within the discharge volume in groups, and each of the groups comprises one electrode of the first type and at least one electrode of the second type. The electrodes of at least one type are isolated from the discharge volume by a dielectric layer.

The disclosed DBD lamps have several advantages over the prior art. They ensure that the available discharge volume is fully used to receive the electrodes of both type (cathodes and anodes) and no other elements are located within the discharge vessel that would decrease the available discharge volume and cause certain shadowing effect. The arrangement of the electrodes of different type inside the discharge vessel and parallel to each other will enable the use of a power supply delivering exiting voltages of 1-5 kV with a frequency in the kHz range. The density of the lines of force of the electric field is substantially higher than in known conventional lamp configurations with external electrodes. The lamp according to the invention will operate with a good efficiency. In addition to this, the lamp can provide a uniform and homogenous volume discharge, and a large illuminating surface.

BRIEF DESCRIPTION OF DRAWINGS

Further aspects and advantages of the invention will be described with reference to enclosed drawings, where.

DETAILED DESCRIPTION OF THE INVENTION

Figure 1:
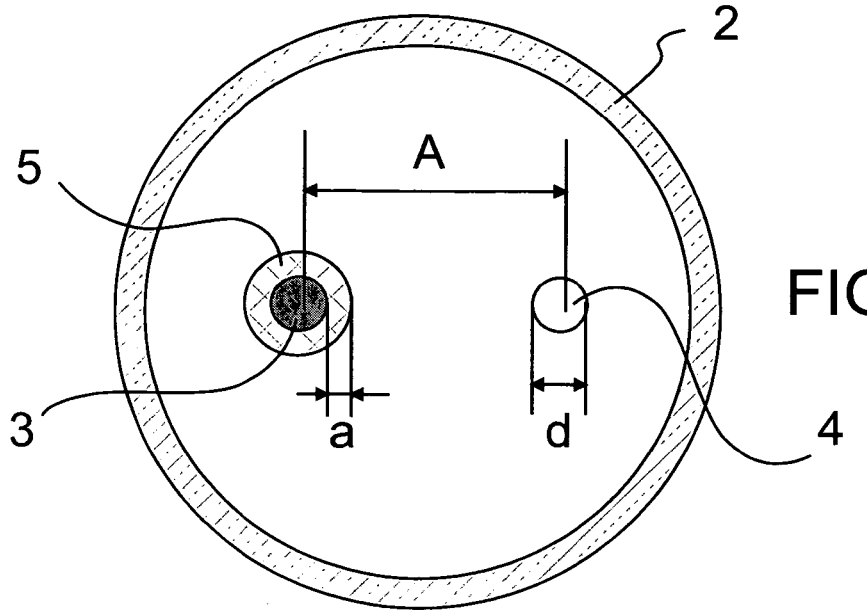
FIG. 1 is a top view in cross section of a dielectric barrier discharge lamp with a cylindrical discharge vessel enclosing two electrodes of different type.
Figure 2:
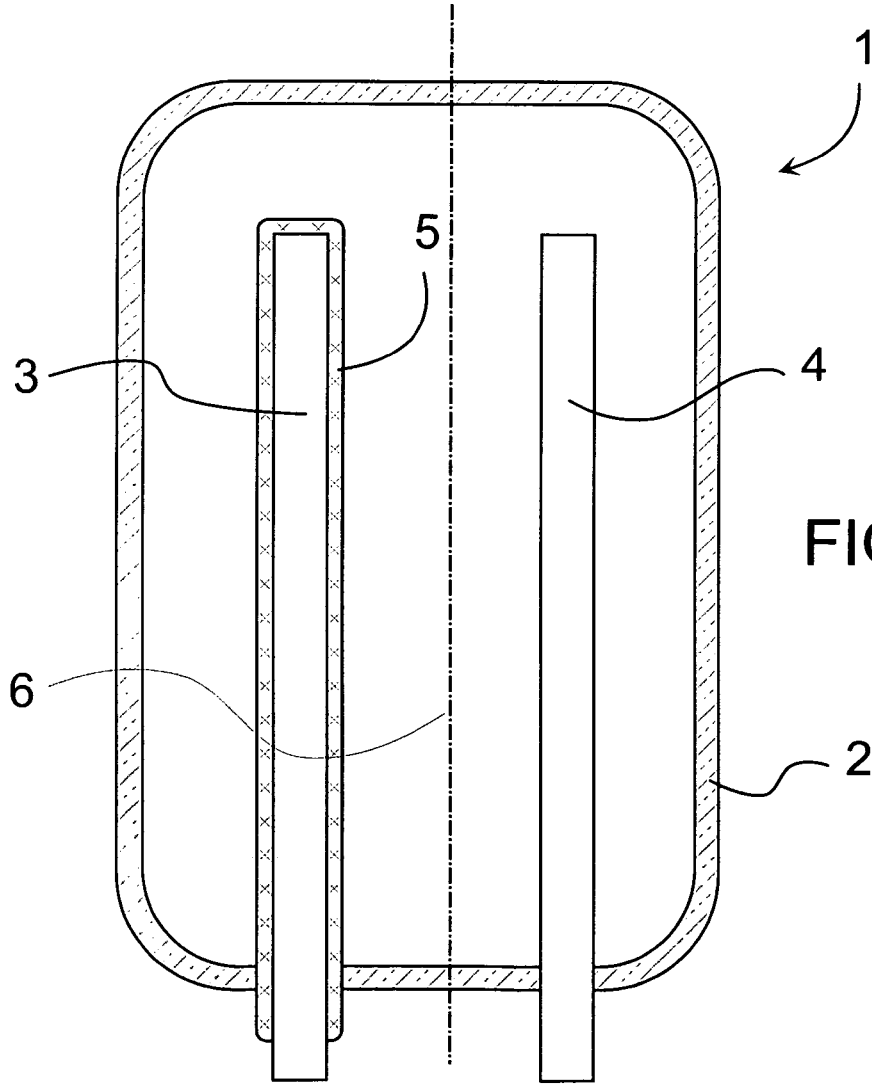
FIG. 2 is a side view in cross section of a dielectric barrier discharge lamp with a cylindrical discharge vessel shown in FIG. 1.

Referring now to FIGS. 1 and 2, there is shown a schematic picture of a low pressure discharge lamp 1. The lamp is a dielectric barrier discharge lamp (hereinafter also referred to as DBD lamp), with a single discharge vessel 2 serving also as an envelope of the DBD lamp. The discharge vessel 2 encloses a discharge volume, which is filled with discharge gas. The wall of the discharge vessel may be coated with a luminescent layer in order to convert short wave radiation of the excited gas into visible light. In the shown embodiment, the discharge vessel is substantially cylindrical and made of a transparent material, which may be a soft or hard glass or any suitable ceramic material which is transparent to the wavelength emitted by the lamp. For reason of higher security, a separate external envelope (not shown) may also be used, which may be made of the same material as the discharge vessel or a suitable plastic material which is transparent to the wavelengths emitted by the lamp. The discharge vessel 2 and the external envelope (if applied) are mechanically supported by a lamp base (not shown), which also holds the contact terminals of the lamp 1, corresponding to a standard plug-in, screw-in or bayonet socket. The lamp base may also house a power source of a known type, which delivers a voltage of 1-5 kV with 50-200 kHz frequency, and need not be explained in more detail. The operation principles of power sources for DBD lamps are disclosed, for example, in U.S. Pat. No. 5,604,410.

Inside the discharge vessel 2, there are two electrodes 3 and 4 of different type arranged substantially parallel to each other and to a principal axis 6 of the discharge vessel 2. The electrodes are energized by a power supply (not shown) in order to act as an anode and a cathode. Both of the electrodes are guided through the same end region of the discharge vessel, which provides for a more convenient connection of the electrodes to the power supply. One of the electrodes is isolated from the discharge volume by a dielectric layer 5. Due to the working principle of the DBD lamps, there must be a dielectric isolating layer between the electrodes of different type, which prevents a continuous arc to be formed. For this purpose it is enough to isolate one of the two electrodes by a dielectric layer as shown in FIGS. 1 and 2. As a dielectric layer any material with sufficiently high dielectric constant that can be bound to the electrode and the discharge vessel may be used. In order to provide for a homogenous discharge along the electrode, the dielectric layer has the same thickness a along the electrode inside the discharge vessel. The thickness of the dielectric layer should be kept as low as possible and may be approximately 0.25 mm. If the material used as a dielectric layer and the material of the discharge vessel are the same, it will be easier to provide hermetic seal in the feed-through region of the discharge vessel.

The electrodes in the proposed embodiment are straight elongated rod-like wires made of a good conductor material, such as silver or copper. The diameter d of the electrodes preferably is approximately 1 mm. Tubular electrodes may also be used in order to reduce the weight of and material used for manufacturing the electrodes. The distance A of the parallel electrodes 3 and 4 is not critical but with increasing distance the magnitude of the exciting voltage also increases. For exciting voltages of 2-5 kV, an electrode distance A of 2 and 5 mm has been found suitable. In order not to exceed the 3 kV limit of the exciting voltage, the distance A of the neighboring electrodes 3 and 4 of different type do not exceed 3 mm. This electrode distance is also termed as the discharge gap, and its value also influences the general parameters of the discharge process within the discharge vessel 2.

Figure 3:
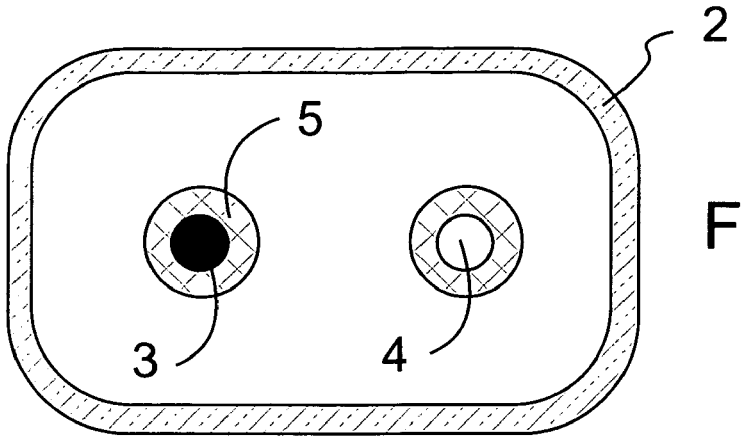
FIG. 3 is a top view in cross section of another embodiment of a DBD lamp, with a different discharge vessel and electrode arrangement.
Figure 4:
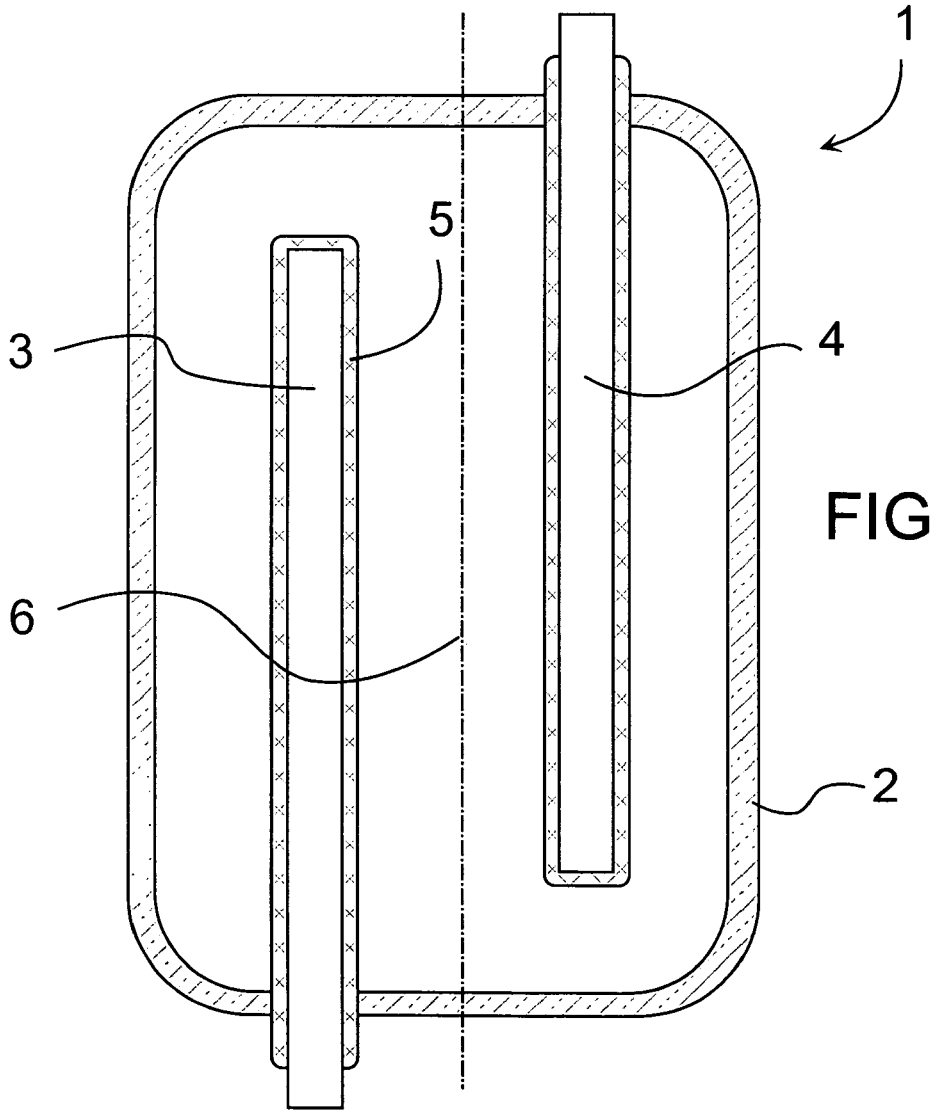
FIG. 4 is a side view in cross section of a DBD lamp with a flat discharge vessel shown in FIG. 3.

FIGS. 3 and 4 show a DBD lamp with a different discharge vessel electrode configuration. Inside the discharge vessel 2, there are two electrodes 3 and 4 of different type arranged substantially parallel to each other and to the principal axis 6 of the discharge vessel 2. The electrodes are energized by a power supply (not shown) in order to act as an anode and a cathode. The electrodes are guided through the opposite end portions of the discharge vessel which provides for a more convenient fixing of the electrodes to the discharge vessel at the feed-through regions of the end portions. Dissimilar to FIGS. 1 and 2, in the embodiment shown in FIGS. 3 and 4, both of the electrodes are isolated from the discharge volume by a dielectric layer 5. As stated above, it is not necessary to apply the dielectric layer to both types of electrodes but it may be of advantage when manufacturing a hermetic seal in the feed-through region of the discharge vessel. Another difference from the first embodiment is that the discharge vessel has a rectangular cross section with slightly rounded corner regions. This discharge vessel arrangement may be useful to provide a more homogenous distribution of the electric field providing also for a more homogenous excitation of the gas within a discharge vessel 2. It has been found that by increasing the number of electrodes, the homogeneity of the electric field and therefore the homogeneity of the discharge distribution may be increased. The following embodiments show different electrode arrangements with at least one electrode of a type.

Figure 5:
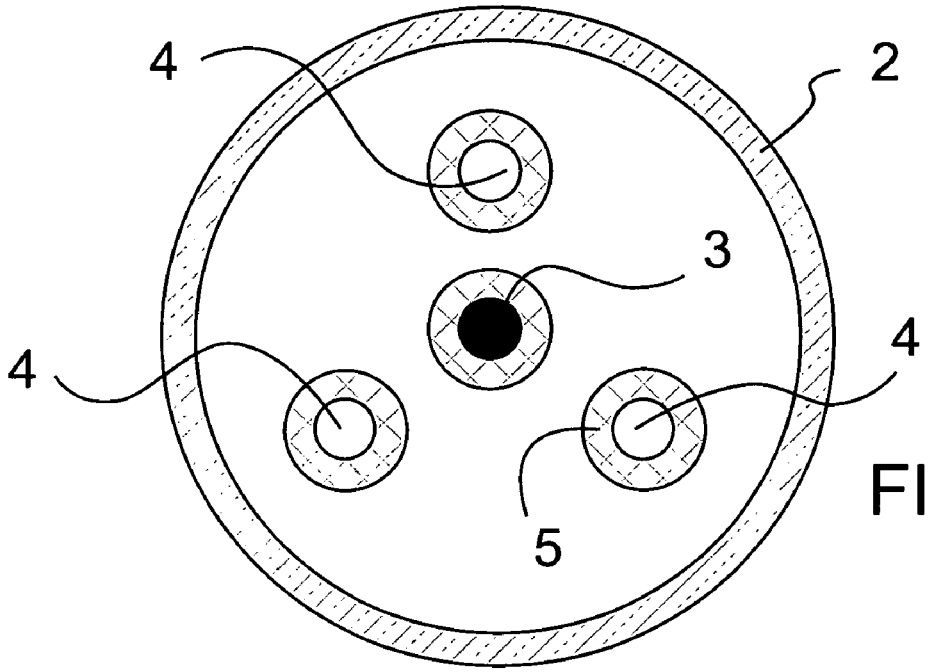
FIG. 5 is a top view in cross section of another embodiment of a DBD lamp, with a cylindrical discharge vessel enclosing four electrodes.
Figure 6:
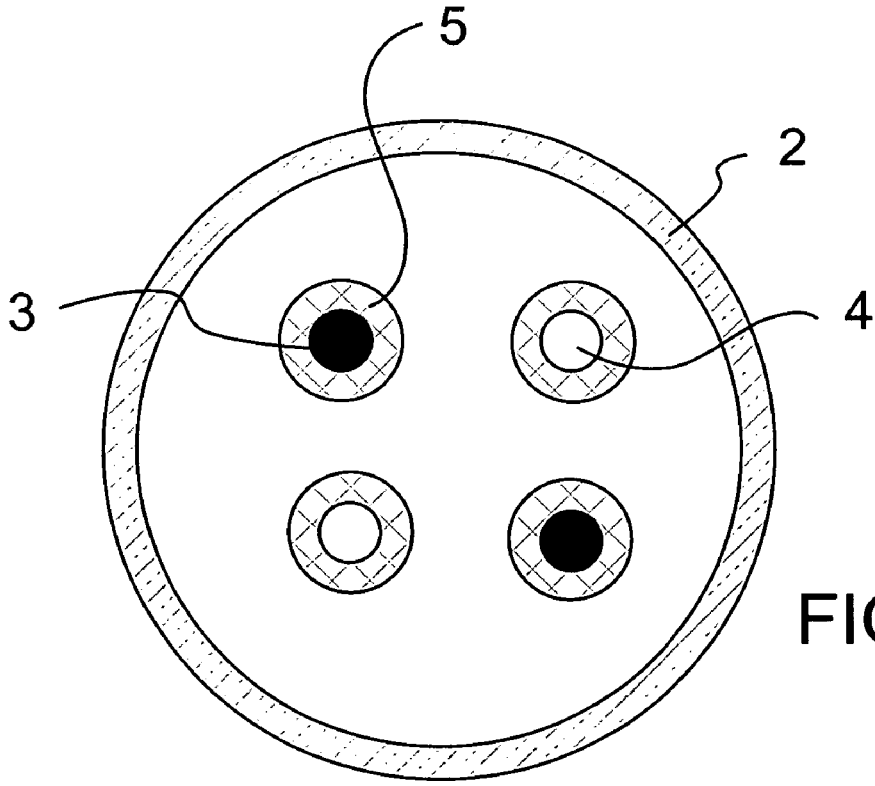
FIG. 6 is a top view in cross section of yet another embodiment of a DBD lamp, with a cylindrical discharge vessel enclosing four electrodes.

In FIGS. 5 and 6, a DBD lamp is shown with four electrodes of different type. In the embodiment shown in FIG. 5, there is one electrode 3 of the first type (anode/cathode) and there are three electrodes 4 of the second type (cathode/anode) around the electrode of the first type. If the distances between the electrodes 4 of the second type and the electrode 3 of the first type are different, the discharge will take place between the electrodes of different type located next to each other. If the distances between the electrodes 4 of the second type and the electrode 3 of the first type are the same, the discharge will take place between the electrode 3 of the first type and the electrodes 4 of the second type accidentally thereby providing a more homogenous discharge distribution within the discharge vessel. In order to generate discharges between all electrodes 3 and 4, it is also important that the parameters (thickness, length, dielectric isolation) of the electrodes are identical. In this arrangement, the four electrodes build a group with only one active pair of electrodes at a time to generate a discharge. In the embodiment shown in FIG. 6, there are two electrodes of the first type (anode/cathode) and two electrodes of the second type (cathode/anode) inside the discharge vessel 2. In this arrangement, two electrodes of different type build a group (pair) of electrodes with only one electrode assigned to one of the two types, therefore it is possible to establish two discharge paths at the same time (in each excitation interval). According to the fact that two discharge paths are generated at the same time, the luminosity of the arrangement is doubled with respect to the embodiment shown in FIG. 5 with the same number of electrodes. If the distance between the electrodes of a pair is smaller than the distance between the pairs, two constant discharge paths will be formed. If however the four electrodes are arranged on the corner points of a square, as shown in FIG. 6, e.g. the distances between the electrodes of a pair and between the pairs is the same, discharge paths will be formed resulting in a more homogenous gas excitation.

An even better luminosity of the DBD lamp can be achieved if an electrode array of several groups of electrodes is used inside the discharge vessel. In such an array of several groups of electrodes in a discharge vessel, the number of concurrent discharge paths is equal to the number of groups in the array. Each group consists of one electrode of the first type (anode/cathode) and at least one electrode of the second type (cathode/anode). If the distance of electrodes in a group of electrodes is different, the discharge will take place between the electrodes of different type located next to each other. If the distances between the electrodes of the different types are the same, the discharge will take place between the electrode of the first type and the electrodes of the second type accidentally thereby providing a more homogenous discharge distribution within the discharge vessel. In order to generate discharges between each electrode, it is also important that the parameters (thickness, length, dielectric isolation) of the electrodes are identical.

The electrodes of the second type may be arranged in a two-dimensional periodic lattice, and the electrodes of the first type may be arranged in the middle of the lattice cells. In the preferred embodiments shown in FIGS. 7 and 8, the electrodes are arranged in a hexagonal lattice (resembling a honeycomb pattern). The hexagonal arrangement is preferable because a hexagonal lattice has a relatively high packing density, as compared with other periodic lattices, e.g. a square lattice. This means that the useful volume of the discharge vessel 2 is filled most efficiently in this manner, at least when it is desired to maximize the $(\Sigma_i V_i)/Ve$ ratio, where $V_i$ is the volume of the i-th electrode, and Ve is the volume of the discharge vessel 2.

The number of electrodes 3 and 4 within a discharge vessel 2 may vary according to size or desired power output of the lamp 1. For example, seven, nineteen or thirty-seven electrodes may form a hexagonal block.

Figure 9:
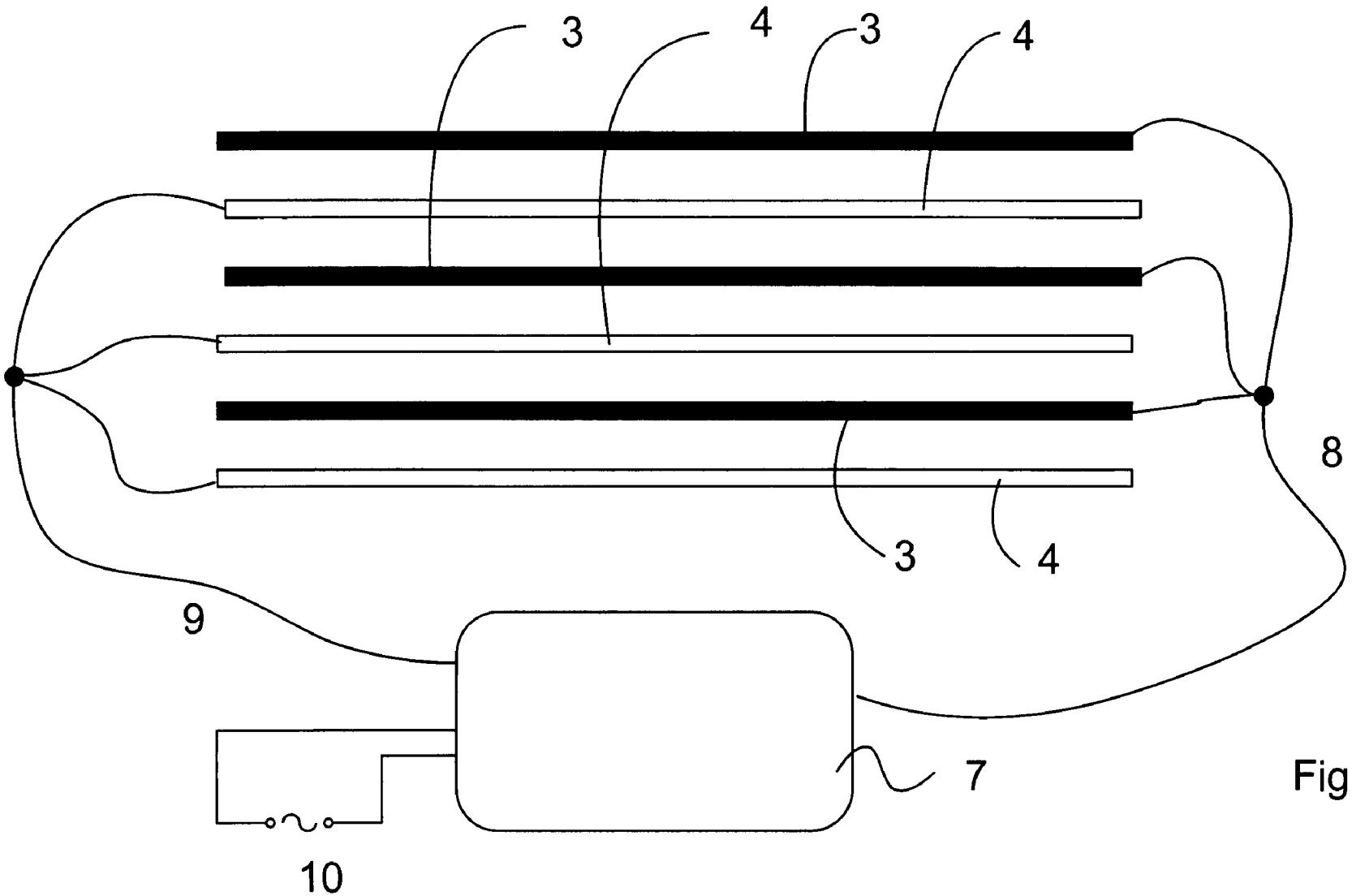
FIG. 9 is a schematic side view of the electrode arrangement with the electrodes of the same type being interconnected with each other and connected to a power supply.

The dielectric barrier discharge (also termed as dielectrically impeded discharge) is generated by a first set of interconnected electrodes 3 and a second set of interconnected electrodes 4. The term "interconnected" indicates that the electrodes 3 and 4 are on a common electric potential, i.e. they are connected with each other within a set, as shown in FIG. 9. The electrodes 3 of the first type are connected with each other at their end with one terminal of a power supply 7 via conductor 8 and the electrodes 4 of the second type are connected with each other at their end with the other terminal of a power supply 7 via conductor 9. The power supply 7 is connected to the mains voltage 10. In order to ensure better overview of the two electrode sets, electrodes 4 of the second type (cathodes/anodes) are white while electrodes of the first type (anodes/cathodes) 3 are black in the drawings. The electrodes of the same type may be interconnected inside the discharge volume or outside the discharge volume. The electrodes of different types may be led through the discharge vessel at the same end portion thereof. The end portions of the discharge vessel are intersected by the principal axis. It is also possible that the electrodes of the first type are led through the discharge vessel at a first end portion and the electrodes of the second type are led through the discharge vessel at a second end portion opposite to the first end portion.

Figure 7:
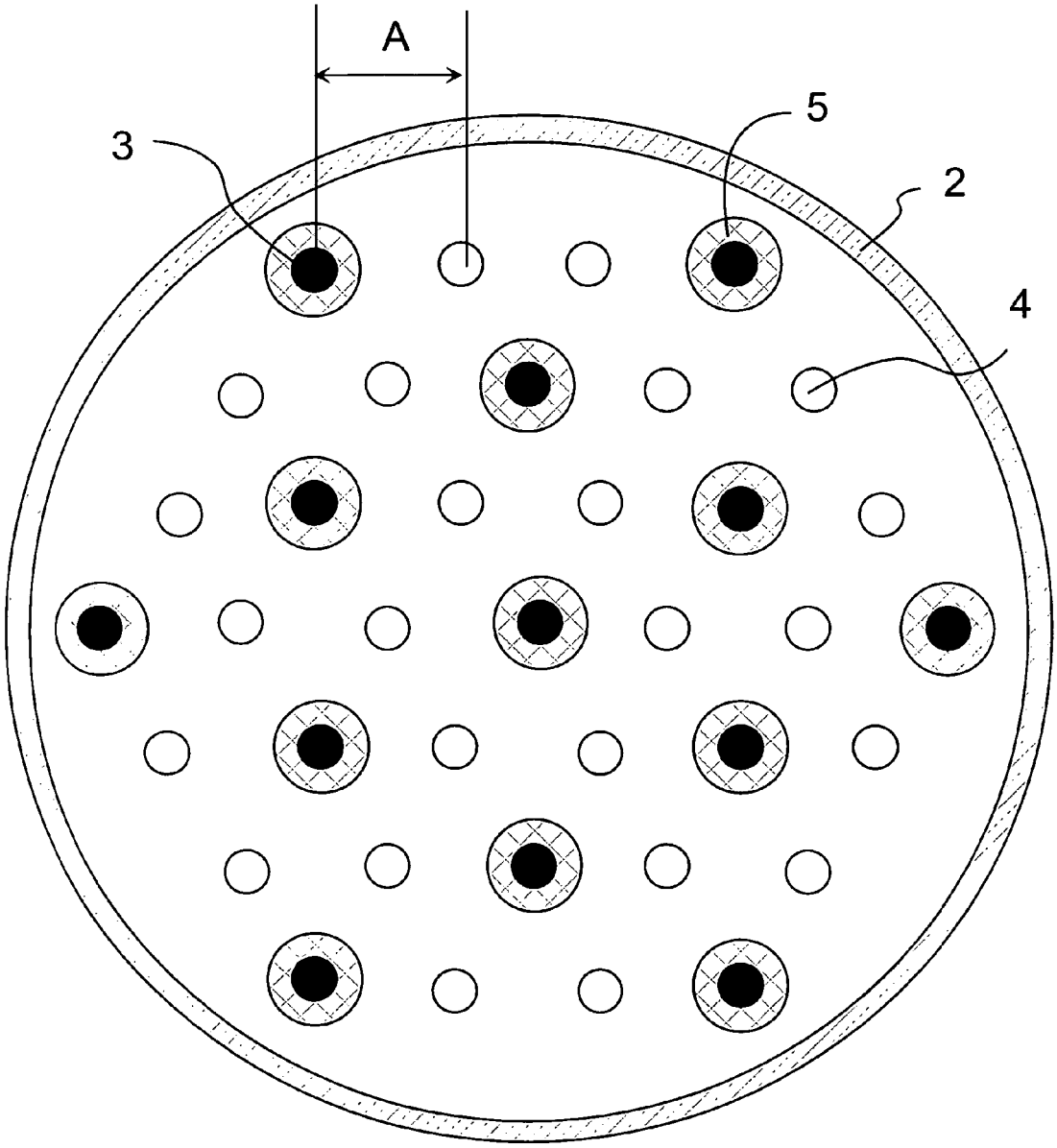
FIG. 7 is a top view in cross section of a further embodiment of a DBD lamp, with a cylindrical discharge vessel enclosing an array of electrodes.

In the embodiment shown in FIG. 7, the distance between two neighboring electrodes of different type is approx. 3-5 mm. This distance is also termed as the discharge gap, and its value also influences the general parameters of the discharge process within the discharge vessel 2.

Figure 8:
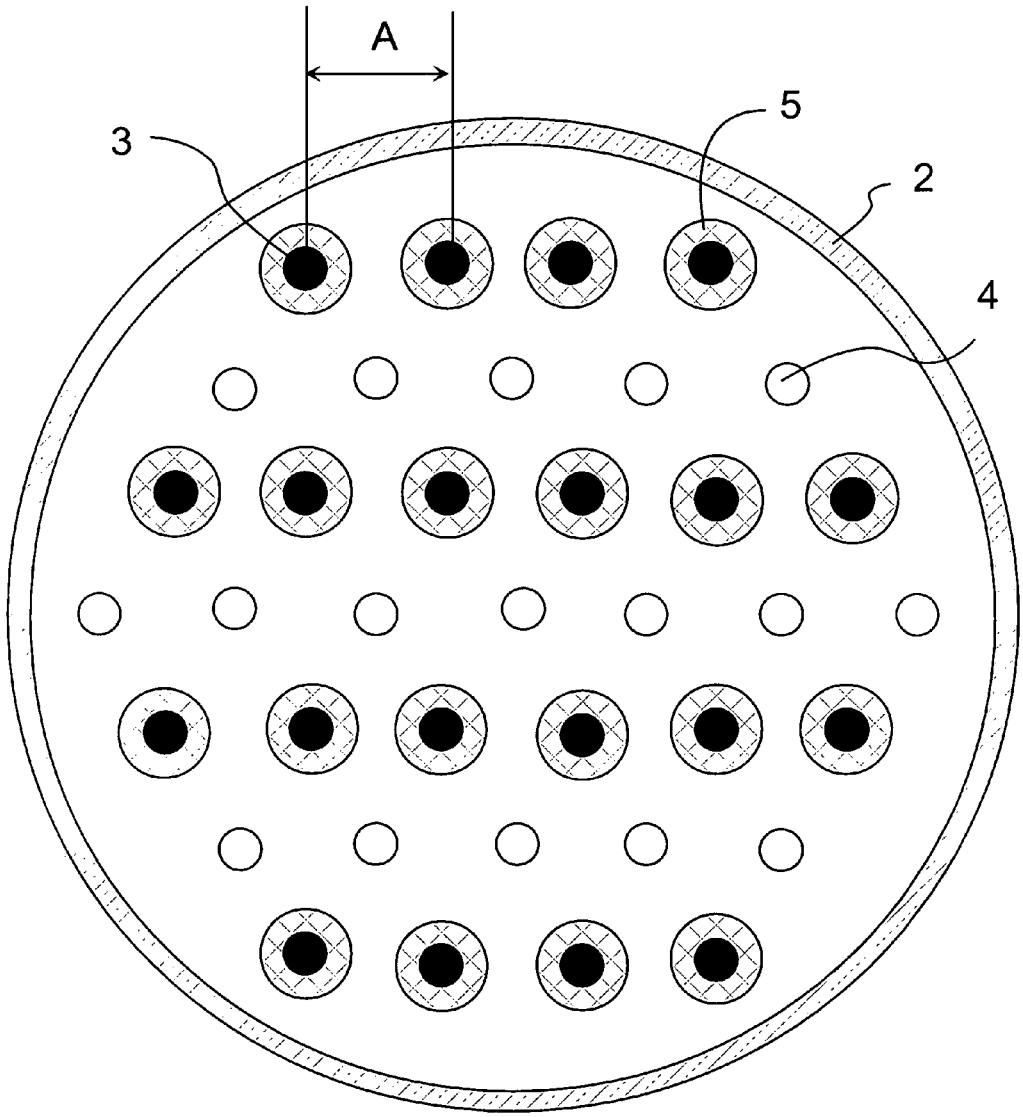
FIG. 8 is a top view in cross section of another embodiment of a DBD lamp, with a cylindrical discharge vessel enclosing an array of electrodes.

As shown in FIGS. 7 and 8, the electrodes 3 and 4 of both the first and second type are placed in the lattice points of the hexagonal lattice. In the embodiment shown in FIG. 7, six (three in the corner points) electrodes of the second type surround one electrode of the first type. In this arrangement, the number of electrodes of the different types is different. The hexagonal lattice is formed of 13 electrodes of the first type and 24 electrodes of the second type, altogether 37 electrodes. It means that during excitation 13 concurrent and independent discharge paths can be formed between the electrodes providing a good luminosity and a high output of light intensity.

In the embodiment shown in FIG. 8, there are only electrodes of the same type in one row with alternating type of electrodes in the neighboring rows. In this arrangement, the number of electrodes of the different types is similar. The hexagonal lattice is formed of 20 electrodes of the first type and 17 electrodes of the second type, altogether 37 electrodes. It means that during excitation 17 concurrent and independent discharge paths can be formed between the electrodes providing an even better luminosity and a higher output of light intensity.

In order to provide a visible light, the internal surface 15 of the discharge vessels 2 is covered with a layer of luminescent material (not shown). As a luminescent material many compounds and mixtures containing phosphor may be used which are well known in the art and therefore need not be explained in more detail here. The luminescent layer converts the UV radiation of the excimer de-excitation into visible light.

This luminescent layer may be applied on the internal or external wall of the discharge vessel 2. If a separate envelope is provided around the discharge vessel, the luminescent layer may also cover the internal surface of the separate envelope. In any case, the envelope is preferably not transparent but only translucent. In this manner, the relatively thin electrodes 3 and 4 within the discharge vessel 2 are barely perceptible, and the lamp 1 also provides a more uniform illuminating external surface. It is also possible to cover the external surface of the discharge vessel or envelope with a luminescent layer, though in this case the discharge vessel 2 must be substantially non-absorbing in the UV range, otherwise the lamp will have a low efficiency.

In all embodiments shown, it is preferred that the wall thickness of the dielectric layer 5 is substantially constant, mostly from a manufacturing point of view, and also to ensure an even discharge within the discharge vessel 2 along the full length of the electrodes. The thickness of the dielectric layer has to be kept as low as possible and may be approximately 0.25 mm.

Finally, it must be noted that the parameters of the electric field and the efficiency of the dielectric barrier discharge within the discharge volume also depend on a number of other factors, such as the excitation frequency, exciting signal shape, gas pressure and composition, etc. These factors are well known in the art, and do not form part of the present invention.

The proposed electrode-discharge vessel arrangement has a number of advantages. Firstly, one discharge vessel 2 may be manufactured more effectively than many thin walled and bended discharge vessels. A relatively large number of electrodes may be used within the discharge vessel for providing a large number of micro-discharges at a time resulting in a homogenous distribution of the discharges and high luminosity of the DBD lamp.

The invention is not limited to the shown and disclosed embodiments, but other elements, improvements and variations are also within the scope of the invention. For example, it is clear for those skilled in the art that a number of other forms of the discharge vessel 2 or envelope may be applicable for the purposes of the present invention, for example, the envelope may have a triangular, square or hexagonal cross-section. Conversely, the electrodes may be arranged in various types of lattices, such as square (cubic) or even non-periodic lattices, though the preferred embodiments foresee the use of periodic lattices with substantially equally shaped, uniformly sized electrodes. Also, the material of the electrodes may vary.

The invention claimed is:

1. A dielectric barrier discharge lamp, comprising a) a discharge vessel having a principal axis, the discharge vessel enclosing a discharge volume filled with a discharge gas, the discharge vessel further comprising end portions intersected by the principal axis, b) at least one electrode of a first type and at least one electrode of a second type, the electrodes of one type being energized to act as a cathode and the electrodes of other type being energized to act as an anode, the electrodes being substantially straight, elongated electrodes with a longitudinal axis substantially parallel to the principal axis of the discharge vessel, c) the electrodes being positioned within the discharge volume, d) the electrodes of at least one type being isolated from the discharge volume by a dielectric layer; and e) the electrodes of the second type arranged in a substantially hexagonal lattice and the electrodes of the first type arranged in the middle of the substantially hexagonal lattice.

2. The lamp of claim 1, in which the electrodes are arranged within the discharge volume in groups, and each of the groups compromises one electrode of the first type and at least one electrode of the second type.

3. The lamp of claim 2, in which the electrodes of the second type are distanced equally with respect to the electrodes of the first type within the groups of electrodes.

4. The lamp of claim 1, in which the electrodes of the same type are interconnected inside the discharge volume.

5. The lamp of claim 4, in which the electrodes of the different types are led through the discharge vessel at the same end portion.

6. The lamp of claim 4, in which the electrodes of the first type are led through the discharge vessel at a first end portion and the electrodes of the second type are led through the discharge vessel at a second end portion opposite to the first end portion.

7. The lamp of claim 1, in which the electrodes of the same type are interconnected outside the discharge volume.

8. The lamp of claim 7, in which the electrodes of the different types are led through the discharge vessel at the same end portion.

9. The lamp of claim 7, in which the electrodes of the first type are led through the discharge vessel at a first end portion and the electrodes of the second type are led through the discharge vessel at a second end portion opposite to the first end portion.

10. The lamp of claim 1, in which the discharge vessel comprises a wall of a transparent material forming an envelope and the wall is covered with a luminescent layer.

11. A dielectric barrier discharge lamp, comprising a) a discharge vessel having a principal axis, the discharge vessel enclosing a discharge volume filled with a discharge gas, the discharge vessel further comprising end portions intersected by the principal axis, b) electrodes of a first type and electrodes of a second type, the electrodes of one type being energized to act as a cathode and the electrodes of other type being energized to act as an anode, the electrodes being substantially straight, elongated electrodes with a longitudinal axis substantially parallel to the principal axis of the discharge vessel, c) the electrodes being arranged within the discharge volume in groups, and each of the groups comprising one electrode of the first type and at least one electrode of the second type;

d) the electrodes of at least one type being isolated from the discharge volume by a dielectric layer; and e) the electrodes of the second type arranged in a substantially hexagonal lattice and the electrodes of the first type arranged in the middle of the substantially hexagonal lattice.

12. The lamp of claim 11, in which the electrodes of the second type are distanced equally with respect to the electrodes of the first type within the groups of electrodes.

13. The lamp of claim 11, in which the electrodes of the same type are interconnected inside the discharge volume.

14. The lamp of claim 13, in which the electrodes of the different types are led through the discharge vessel at the same end portion.

15. The lamp of claim 13, in which the electrodes of the first type are led through the discharge vessel at a first end portion and the electrodes of the second type are led through the discharge vessel at a second end portion opposite to the first end portion.

16. The lamp of claim 11, in which the electrodes of the same type are interconnected outside the discharge volume.

17. The lamp of claim 16, in which the electrodes of the different types are led through the discharge vessel at the same end portion.

18. The lamp of claim 16, in which the electrodes of the first type are led through the discharge vessel at a first end portion and the electrodes of the second type are led through the discharge vessel at a second end portion opposite to the first end portion.

19. The lamp of claim 11, in which the discharge vessel comprises a wall of a transparent material forming an envelope and the wall is covered with a luminescent layer.

* * * * *